US009333753B2

(12) United States Patent
Plummer et al.

(10) Patent No.: US 9,333,753 B2
(45) Date of Patent: May 10, 2016

(54) INK JET PRINT HEAD AND CAP

(71) Applicant: Linx Printing Technologies Ltd, Cambridgeshire (GB)

(72) Inventors: Marc Plummer, Cambridgeshire (GB); Graham Thomas, Cambridgeshire (GB)

(73) Assignee: LINX PRINTING TECHNOLOGIES LTD., Cambridgeshire (GB)

( * ) Notice: Subject to any disclaimer, the term of this patent is extended or adjusted under 35 U.S.C. 154(b) by 0 days.

(21) Appl. No.: 14/419,186

(22) PCT Filed: Sep. 10, 2013

(86) PCT No.: PCT/GB2013/052366

§ 371 (c)(1),
(2) Date: Feb. 2, 2015

(87) PCT Pub. No.: WO2014/041341

PCT Pub. Date: Mar. 20, 2014

(65) Prior Publication Data

US 2015/0239249 A1 Aug. 27, 2015

(30) Foreign Application Priority Data

Sep. 12, 2012 (GB) ..... 1216253.3

(51) Int. Cl.

| | |
|---|---|
| ***B41F 21/14*** | (2006.01) |
| ***B65H 9/00*** | (2006.01) |
| ***B65H 9/04*** | (2006.01) |
| ***B41J 2/165*** | (2006.01) |
| ***B41J 3/407*** | (2006.01) |

(52) U.S. Cl.

CPC ..... *B41J 2/16505* (2013.01); *B41J 3/4073* (2013.01)

(58) Field of Classification Search

CPC ..... B41J 2/16505; B41J 3/4073
USPC ..... 347/29
See application file for complete search history.

(56) References Cited

U.S. PATENT DOCUMENTS

| | | | | |
|---|---|---|---|---|
| 4,380,967 | A * | 4/1983 | Matt | B05B 12/02 118/669 |
| 4,500,894 | A | 2/1985 | Kirner | |
| 4,646,111 | A | 2/1987 | Shimosato et al. | |

(Continued)

FOREIGN PATENT DOCUMENTS

| | | | |
|---|---|---|---|
| DE | 102008019715 | A1 | 10/2009 |
| EP | 1065067 | A1 | 1/2001 |

(Continued)

*Primary Examiner* — Stephen Meier
*Assistant Examiner* — Alexander D Shenderov
(74) *Attorney, Agent, or Firm* — Lynn & Lynn; John H Lynn

(57) ABSTRACT

A cap 13, 15, for the print face 9 of a drop-on-demand ink jet printer moves between a closed position, in which it covers the print nozzles on the print face 9, and an open position in which the print nozzles are uncovered, without requiring movement of the print face 9. In the open position, the cap is recessed relative to the front surface 21 of the printhead. For at least part of the movement of the cap, it is further forward than the print face 9, so that it does not slide across and damage the print nozzles. The drop-on-demand ink jet printer may be used to print onto objects 3 conveyed past it, for example on a packing line. The cap 13, 15, does not obstruct the path of the objects 3 even if they pass very close (e.g. 0.5 mm) to the print face 9 because its uncapped position is further back than the front surface 21 of the printhead.

8 Claims, 8 Drawing Sheets

(56) References Cited

U.S. PATENT DOCUMENTS

| | | | | |
|---|---|---|---|---|
| 4,792,817 | A | 12/1988 | Barney | |
| 5,094,442 | A * | 3/1992 | Kamprath | B65H 9/002 271/227 |
| 5,101,224 | A * | 3/1992 | Freed, Jr. | B41J 2/01 346/145 |
| 5,682,186 | A | 10/1997 | Bohorquez et al. | |
| 5,757,395 | A | 5/1998 | Chew | |
| 6,336,698 | B1 | 1/2002 | Imai | |
| 2004/0008235 | A1 | 1/2004 | Keyes et al. | |
| 2004/0109718 | A1 * | 6/2004 | Ikeno | B41J 11/0095 400/708 |
| 2006/0066705 | A1 | 3/2006 | James, III et al. | |
| 2006/0119645 | A1 | 6/2006 | Berry et al. | |
| 2007/0222813 | A1 | 9/2007 | Lee | |
| 2008/0231653 | A1 | 9/2008 | Kawashima | |
| 2008/0309702 | A1 | 12/2008 | Takahashi | |
| 2010/0302309 | A1 | 12/2010 | Hatta et al. | |
| 2011/0242195 | A1 | 10/2011 | Sugimoto | |
| 2012/0194612 | A1 * | 8/2012 | Dietl | B41J 2/16508 347/37 |

FOREIGN PATENT DOCUMENTS

| | | | |
|---|---|---|---|
| EP | 1201436 | A1 | 5/2002 |
| GB | 2025853 | | 1/1980 |
| GB | 2055768 | A | 3/1981 |
| JP | 61230946 | | 10/1986 |
| JP | 10157245 | A | 6/1998 |
| JP | 04166356 | A | 8/2013 |
| JP | 06040103 | A | 8/2013 |
| WO | WO9921722 | A2 | 5/1999 |
| WO | WO2009127194 | A2 | 10/2009 |
| WO | WO2011147485 | A1 | 12/2011 |

* cited by examiner

INK JET PRINT HEAD AND CAP

The present application relates to ink jet printers, arrangements for capping a print head of an ink jet printer, and print heads with a capping arrangement.

Most ink jet printers can be divided into two types. The first type is a continuous jet printer. In a continuous ink jet printer, an ink jet runs continuously during a printing operation, and drops of ink are deflected (usually electrostatically) to direct them either to the surface that is being printed onto or alternatively to a gutter which collects drops that are not used for printing. Continuous ink jet printers are typically used for industrial printing such as printing logos, sell-by dates and other information onto cartons, food packaging, foodstuffs such as eggs, and also, for example, printing onto cabling. The second type is a drop-on-demand printer. Typically, a drop-on-demand printer has a print head with at least one row with a large number of nozzles, and an arrangement (for example a piezoelectric crystal or a heater for boiling ink) that ejects a single drop from a particular nozzle when required for printing. The nozzles and the arrangement for ejecting drops on demand may be permanent parts of the print head, or they may be part of a removable cartridge (often also including one or more ink reservoirs) that is replaced from time to time (for example when the ink reservoir or reservoirs have run out of ink). Drop-on-demand ink jet printers are typically used for printing the output of home computers.

The solvent or solvents in the ink used in ink jet printers tends to evaporate quickly. This is necessary in order to ensure that the ink drops dry quickly during the printing operation. However, this means that if ink sits in a print head that is not being used for printing, there is a tendency for the solvent to evaporate through the print head nozzle or nozzles, with the result that the ink dries out and blocks the nozzle or nozzles. With a continuous ink jet printer, this is not a problem while the printer is operational, because the jet is running continuously. When the jet closes down, the printer may perform a special shut down sequence in which ink is sucked out of a print head and the print head is flushed with pure solvent in order to prevent any ink drying out at the nozzle. In a drop-on-demand printer, it is normal that whenever printing is not taking place, the print head is moved to a capping station just outside the range of positions at which the printer can print, and then either the print head or a cap is moved so that the cap closes over the nozzles to prevent evaporation. Additionally, the print head may discharge ink into a pad in the capping mechanism in order to dissolve and clear away any encrustations of dried ink. When the printer receives the signal to print another page, the print head is moved from the capping station back to its range of normal printing positions.

It is also known to provide a protective cap mounted a print cartridge itself. For example, EP 0676292 suggests that a permanent capping station may become dirty or wear out, and proposes that an ink pen may be provided with its own protective cover. In EP 0676292, a coil of stainless steel is seated in a cavity behind and to one side of the print face having the print nozzles. At each end, the coil is attached to an arm that rotates about an axis parallel to the print face, so that rotation of the arms brings one end of the coil over the print face, forming a protective cover.

U.S. Pat. No. 5,682,186 proposes several capping arrangements mounted on an ink pen. In one embodiment, a cap is mounted for rotation about an axis parallel to the print face so as to flip between a closed position in which it covers the print nozzles and an open position in which the nozzles are exposed. In the open position, the cap lies next to the print face, but further back (i.e. further from the surface to be printed onto), where it does not interfere with the operation of the ink pen or printer. The cap may have a gasket, which contacts the print face in the closed position to form a protective chamber around the nozzles without the cap being in contact with the nozzles. A vent through the cap may prevent an air pressure spike within the protective chamber from forcing air into the nozzles. The cap can be driven between its open and closed positions by a motor in the printer that engages with the cap when the ink pen is at its home station. Alternatively, a spiral cam can be positioned to engage with the cap and move it into or out of its closed position as the ink pen moves towards or away from the home station.

In another embodiment, U.S. Pat. No. 5,682,186 proposes a cap that slides across the print face between its open and closed positions. This cap may have a gasket to form a protective seal around the nozzles. It may also have a wiper that wipes across the nozzles as the cap moves, to remove dirt, debris and accumulated ink. In a further embodiment, a page-wide printhead, with a curved print face, is provided with a cap that is arranged to move between its open and closed positions by pivoting about an axis that is parallel to the print face but behind it (i.e. further from the surface to be printed onto). The cap may have a gasket to form a protective chamber around the nozzles, and a wiper. The pivot axis may be offset from the centre of curvature of the print face so that the gasket lifts from the print face as the cap is pivoted.

It has been proposed to use a drop-on-demand printer for industrial printing, but a problem arises from the tendency of the ink to dry in the print head nozzles. In an industrial setting it may not be practical to move the print head to a capping station, either because the printer has to fit into a very small space on an industrial packing line or because it is difficult to move the print head fast enough from the capping position to the printing position in response to a signal that indicates detection of an item to be printed into, in view of the very high speed at which industrial packing lines tend to operate.

US 2004/0008235 proposes an arrangement in which a slidable shutter can be moved across the face of a print head or print cartridge, between a closed position in which it covers the print head and an open position in which it exposes the print head. The shutter is moved by a spring-loaded arm that extends across the conveyor carrying products to be printed onto. The spring tends to move the arm and shutter into the closed position and when a product passes down the conveyor it hits the arm and pushes it back, moving the shutter into the open position as the product moves past the print head. As soon as the product is gone, the spring moves the arm so as to bring the shutter back to the closed position.

WO 2009/127194 proposes a closure device mounted on the front of a print head that holds a removable print cartridge, for printing onto work pieces that are conveyed past it. The closure device has a slidable cap with an opening in it. In the open position of the cap, the print face of the print cartridge (having the print nozzles) projects through the opening in the cap. This allows the print face to be very close to the work pieces. When the cap slides from the open position towards the closed position, cam surfaces move the cap towards the path of the work pieces, so that it can pass in front of the print face into the closed position. An elastomer on the cap presses against the nozzles, sealing them in the closed position.

According to an aspect of the present invention, there is provided an ink jet printer, or a print head for an ink jet printer, the printer or print head either comprising a plurality of print nozzles at a predetermined position on a print face or comprising a mount for holding a removable unit that comprises a plurality of print nozzles at a predetermined position on a print face, the printer or print head further comprising a capping member movable along a predetermined path between a closed position and an open position, the capping member in the open position being further back, with respect to the direction of ink ejection from the nozzles, than the position of the print face, the capping member in the closed position pressing resiliently against the print face and sealing around the nozzles without touching them, and the predetermined path including a portion that is further forward, with respect to the direction of ink ejection from the nozzles, than both the open position and the closed position whereby the capping member is movable across the nozzles without making sliding contact with the nozzles.

According to another aspect of the present invention there is provided a method of capping a plurality of print nozzles at a predetermined position on a print face of an ink jet printer or a print head for an ink jet printer, the method comprising moving a capping member along a predetermined path between a closed position and an open position, wherein: when the capping member is in the open position it is further back, with respect to the direction of ink ejection from the nozzles, than the position of the print face; when the capping member is in the closed position it presses resiliently against the print face and seals around the nozzles without touching them; the predetermined path includes a portion that is further forward, with respect to the direction of ink ejection from the nozzles, than both the open position and the closed position; and the capping member moves across the nozzles without making sliding contact with the nozzles.

According to another aspect of the present invention there is provided an ink jet printer, or a print head for an ink jet printer, that either has a print face with a plurality of drop-on-demand printing nozzles or is arranged to receive a removable print cartridge having a predetermined shape and hold such a print cartridge with its print face substantially at a predetermined position. The printer or print head comprises a capping arrangement having a cap that is movable by a cap drive between a closed (or capping) position and an open (or printing) position. When the cap is in its closed (capping) position it is in front of the print face, in contact with the print face and pressed against the print face, and when it is in its open (printing) position it is further back, with reference to the direction of movement of ink drops out of the nozzles during a printing operation, than the print face. When the cap moves between the open and closed positions, it passes through an intermediate position where it is spaced further forward than its closed position and does not contact the print face of the print cartridge. When the cap is in its intermediate position it is able to move without sliding contact with the print face.

Preferably the cap or capping member is tiltable with respect to the plane of the print face, when in the closed position.

Preferably the cap is moved with a rotational movement about an axis substantially perpendicular to the plane of the print face, to move the cap generally parallel to the plane of the print face, accompanied by movement generally along the axis in order to vary how far forward the cap is. Preferably the axial movement is provided by an arrangement of cams that move the cap along the axis as it rotates. The cam surfaces may be covered by the cap, or a part that moves with it, both in the open position and in the closed position of the cap. The cam surfaces are preferable covered throughout the rotation of the cap between the closed and open positions. Preferably the cam surfaces are provided on axially spaced facing surfaces within a recess in the printhead, and one of the axially spaced facing surfaces is a surface of a member that is, includes or moves with the cap, the member substantially closing the recess in the printhead. This arrangement tends to protect the cam surfaces from dirt and dust.

According to another aspect of the present invention there is provided an ink jet printer, or a print head for an ink jet printer, the printer or print head either comprising a plurality of print nozzles in a substantially planar print face or comprising a mount for holding a removable unit that comprises a plurality of print nozzles in a substantially planar print face, the printer or print head further comprising: a capping member movable between an open position, in which the capping member does not cap the nozzles, and a closed position in which the capping member caps the nozzles, the capping member moving between the open and closed positions by rotation about an axis transverse to the plane of the print face; and an arrangement of cams to drive the capping member along the axis of rotation by interaction of opposing cam surfaces during at least part of its rotation between the open and closed positions, the cam surfaces being in a recess in the print head and being covered by a portion of the capping member at the open position and at the closed position.

According to another aspect of the present invention there is provided a method of operating an ink jet printer or a print head for an ink jet printer, the printer or print head either comprising a plurality of print nozzles in a substantially planar print face or comprising a mount for holding a removable unit that comprises a plurality of print nozzles in a substantially planar print face, the method comprising; moving a capping member between a closed position, in which the capping member caps the nozzles, and an open position, in which the capping member does not cap the nozzles, by rotating the capping member about an axis transverse to the plane of the print face; and driving the capping member along the axis of rotation, by interaction of opposing cam surfaces, during at least part of its rotation between the open and closed positions, wherein the cam surfaces are in a recess in the print head, and the cam surfaces are covered by a portion of the capping member at the open position and at the closed position.

According to another aspect of the present invention there is provided an ink jet printer or a print head for an ink jet printer, the printer or print head having a printing position from which ink can be ejected for printing and the printer or print head being suitable for mounting alongside a conveyor so that the conveyor can convey products, to be printed onto, past the printing position of the printer or print head in a conveying direction, the printer or print head comprising: a ramp portion extending away from the printing position, the ramp portion being suitable to be mounted, when the printer or print head is mounted alongside a conveyor, so that it extends upstream, relative to the conveying direction, of the printing position and so that it has a ramp surface facing the conveyor, the ramp surface being angled relative to the conveying direction with (a) the end of the ramp surface that is furthest from the printing position being further sideways from the conveyor than the printing position, and (b) a place on the ramp surface spaced from the end being no further sideways from the conveyor than the printing position, whereby a product conveyed by the conveyor that strikes the ramp surface between its end and the said place will be forced sideways relative to the conveying direction as it is conveyed past the ramp surface so as to be no further sideways than the printing position before it reaches the printing position; a first sensor, for sensing the presence of a product passing the first sensor, the first sensor being mounted on the said ramp portion; and a second sensor, for sensing the presence of a product passing the second sensor, the second sensor being spaced from the first sensor in the direction from the first sensor towards the printing position.

Preferably the ramp portion is detachable. The second sensor may be between the first sensor and the printing position. In this case it may also be mounted on the ramp portion. Alternatively, the printing position may be between the first sensor and the second sensor. In this case, the second sensor may be mounted on a further ramp portion, extending away from the printing position, the further ramp portion being suitable to be mounted, when the printer or print head is mounted alongside a conveyor, so that it extends downstream, relative to the conveying direction, of the printing position and so that it has a ramp surface facing the conveyor, the ramp surface being angled relative to the conveying direction with (a) the end of the ramp surface that is furthest from the printing position being further sideways from the conveyor than the printing position, and (b) a place on the ramp surface spaced from the end being no further sideways from the conveyor than the printing position.

Further aspects and optional features of the invention are set out in the claims, which are hereby incorporated into the description.

In an embodiment, a capping member for the print face of a drop-on-demand ink jet printer is movable between a closed position, in which it covers the print nozzles on the print face and is pressed against the print face, and an open position in which the print nozzles are uncovered, without requiring movement of the print face. In the open position, the capping member is further back, with reference to the direction of movement of ejected ink drops, than the print face and/or the front surface of the printer or print head. For at least part of the movement of the capping member across the print face, it is further forward than the print face, so that it does not slide across and damage the print nozzles on the print face. The capping arrangement is suitable for use when the drop-on-demand ink jet printer is used to print onto objects conveyed past it, for example on a packing line, because the uncapped position of the capping member is further back than the print face and/or the front surface of the printer or print head and does not obstruct the path of the objects even if they pass very close (e.g. 0.5 mm) to the print face.

Embodiments of the invention, given by way of non-limiting example, will be described with reference to the accompanying drawings.

Figure 1:
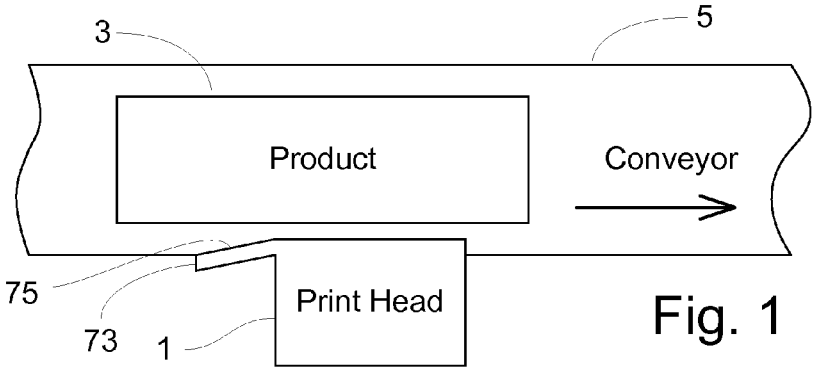
FIG. 1 shows a conveyor with a print head fitted with a capping arrangement embodying the present invention.

FIG. 1 shows schematically a print head 1 of a drop-on-demand ink jet printer positioned to print onto a plurality of products 3 that are carried past the print head 1 by a conveyor which carries the products in the direction shown by the arrow. The print head 1 is fitted with a removable drop-on-demand print cartridge, having a print face. The print face is a substantially planar face having a plurality of ink jet nozzles on it. Typically the print face will have a large number of drop-on-demand print nozzles, arranged in one or more rows. Each drop-on-demand print nozzle is arranged to eject a drop of ink when a drop of ink is required from that nozzle for printing (i.e. a printed mark is required on the product 3 at a position in front of the nozzle concerned) but each nozzle does not normally eject a drop of ink when it is not required for printing. The print head 1 is positioned just above the edge of the conveyor 5 so that products 3 pass close in front of the print face of the print cartridge in the print head 1. Preferably, the products 3 pass in front of the print face with a spacing of no greater than 5 mm, since drop-on-demand printers typically are able to eject ink drops only over a very short distance. To get the best print quality, the distance between the product 3 and the print face may need to be 1 mm or less, for example about 0.5 mm.

FIG. 1 shows a print head 1 at the conveyor 5, with other parts of the printer (for example control electronics and a user interface) being provided in a separate printer body (not shown) spaced further away from the conveyor 5. It is possible as an alternative to provide the entire printer at the position shown for the print head 1 in FIG. 1, especially in the case that the printer is provided in a single body without a separate print head. Additionally, as a further alternative the printer or the separate print head 1 may comprise a print face with print nozzles, instead of the print face and nozzles being part of a removable print cartridge. In this case, the printer or print head may nevertheless receive a removable cartridge that contains one or more ink reservoirs, even though the cartridge does not provide the print face and print nozzles. The print face and the print nozzles may be part of a removable print unit, rather than being a permanent part of the print head 1, even in the case where the print face and the print nozzles are not part of a removable print cartridge along with one or more ink reservoirs. This allows the ink reservoirs to be replaced as they become empty, without replacing the print nozzles every time the ink cartridge is replaced, but the print unit can itself be removed and replaced if the print nozzles wear out or cease to work properly. If the print face and print nozzles are removable from the print head, such as when they are part of a removable print unit or a removable print cartridge, the print head will include a mount for holding the removable unit or cartridge in position, with the print face at the desired location relative to the front face of the print head. However, owing to slight manufacturing differences from one removable cartridge or unit to another, and the possibility that the position of a removable cartridge or unit in the mount may be slightly different from one occasion to another, the position of the print face and the nozzles may vary slightly.

Because the ink used by the printer tends to dry out very quickly, the print nozzles are sealed by a cap except when a product 3, or a succession of products 3, are being carried passed the print head 1 by the conveyor 5. When it is detected that a product 3 is approaching the print head 1, the cap is rapidly removed, to allow the printer to print onto the product 3.

Figure 2A:
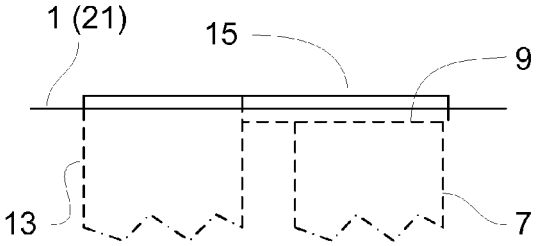
FIGS. 2A to 2C are schematic views from below of part of the capping arrangement.
Figure 3A:
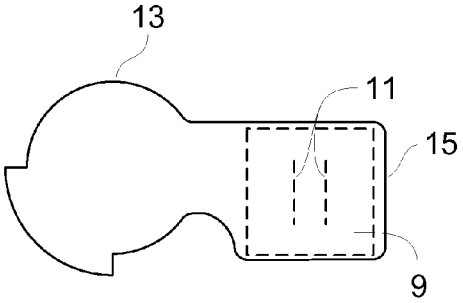
FIGS. 3A to 3C are schematic views from the front of part of the capping arrangement.
Figure 2B:
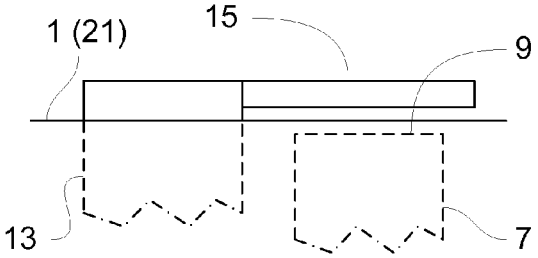
Figure 3B:
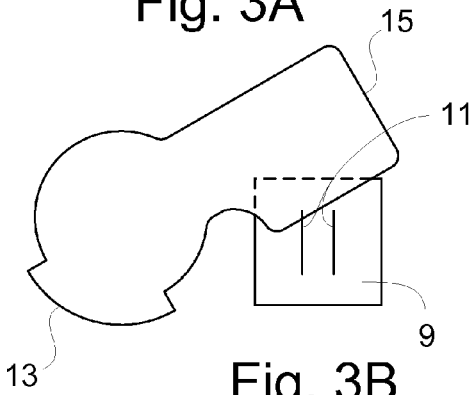
Figure 2C:
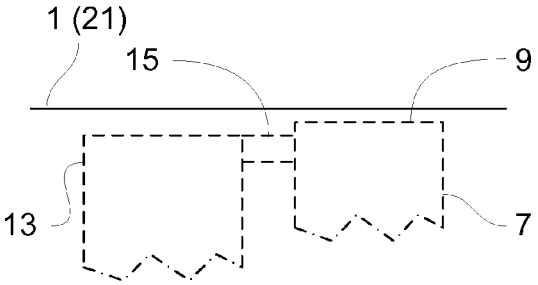
Figure 3C:
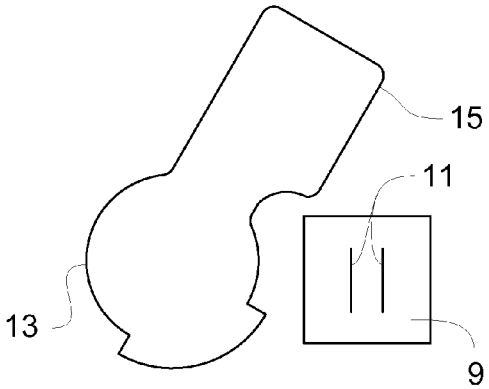

FIGS. 2A, 2B and 2C provide schematic views of part of the capping arrangement from below, and FIGS. 3A, 3B and 3C show schematic views of part of the capping arrangement from the front. A removable print cartridge 7 has a print face 9 with two rows 11 of nozzles. Each row 11 contains, for example, 150 drop-on-demand print nozzles. The print face 9 of the print cartridge 7 is substantially planar and is roughly in line with the front surface of the print head 1, but in practice will tend to be very slightly further back, typically by about 0.1 mm to 0.5 mm. The print cartridge 7 may be a standard Hewlett Packard-type HP51645A, that includes both the print face 9 and rows 11 of print nozzles and also at least one ink reservoir. The ink reservoir will be filled with a suitable ink for printing onto the products 3.

A rotatable shutter 13 has a capping arm 15, extending sideways so as to be movable by rotation of the shutter 13, which acts as a cap for the rows 11 of nozzles on the print face 9 of the print cartridge 7.

In FIGS. 2A and 3A, the shutter 13 is positioned so that the capping arm 15 extends across the print face 9, and is pressed against it, thereby capping the rows 11 of nozzles. Because of the thickness of the capping arm 15, its front surface protrudes in front of the front surface of the print head 1, and is liable to obstruct the path of products 3 if they are positioned to pass in front of the print head 1 with a spacing of less than 2.5 mm.

In FIGS. 2B and 3B, the shutter 13 is partway through its movement between the closed position of FIGS. 2A and 3A, in which the capping arm 15 caps the nozzles of the print cartridge 7, and an open position in which the nozzles are not obstructed and print cartridge 7 is free to print. In this intermediate position, the shutter 13 has moved forwards, further into the path of the products 3 (as can be seen in FIG. 2B). This allows the shutter 13 to rotate without the capping arm 15 sliding across the print face 9. This helps to avoid damage to the print nozzles that might otherwise occur if any part of the capping arm 15 came into sliding contact with any of the nozzles.

In FIGS. 2C and 3C, the shutter 13 is in its open position, and the print cartridge 7 is free to print. In this position, the shutter 13 has rotated sufficiently that the capping arm 15 is clear of the print face 9, as can be seen in FIG. 3C. Additionally, the shutter as a whole has retracted back into the print head 1, so that it is now entirely behind the front face of the print head 1 and the print face 9 of the print cartridge 7, as can be seen in FIG. 2C. Accordingly, in this position the shutter 13 does not obstruct the path of the products 3 even if they pass extremely close to the print head 1 and the print face 9. This allows the "throw distance" between the print face 9 and the products 3 to be minimised, thereby improving the quality of the printing on the products 3.

The terms "forwards", "in front" "behind", "rearwards" etc can be defined by reference to the direction of movement of the ink drops that are ejected from the nozzles of the print face 9 (the ink drops move forwards as they are ejected). Alternatively, these terms can be defined by reference to the plane of the print face itself, with "forwards" and "rearwards" being directions perpendicular to the plane of the print face and "front" being the side of the print face where the capping arm 15 is positioned when it is pressed against the print face 9 to cap the nozzles.

The construction of the print head 1 and the shutter 13 will now be described in more detail.

Figure 4:
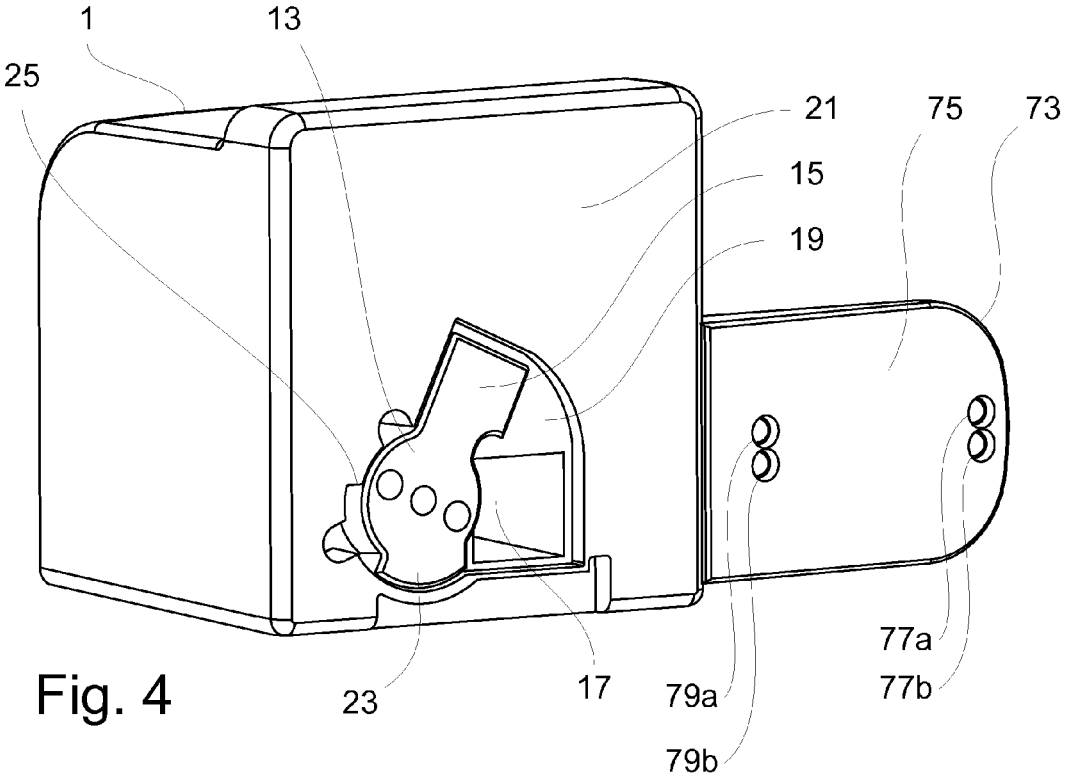
FIG. 4 shows the print head with its capping shutter open.
Figure 5:
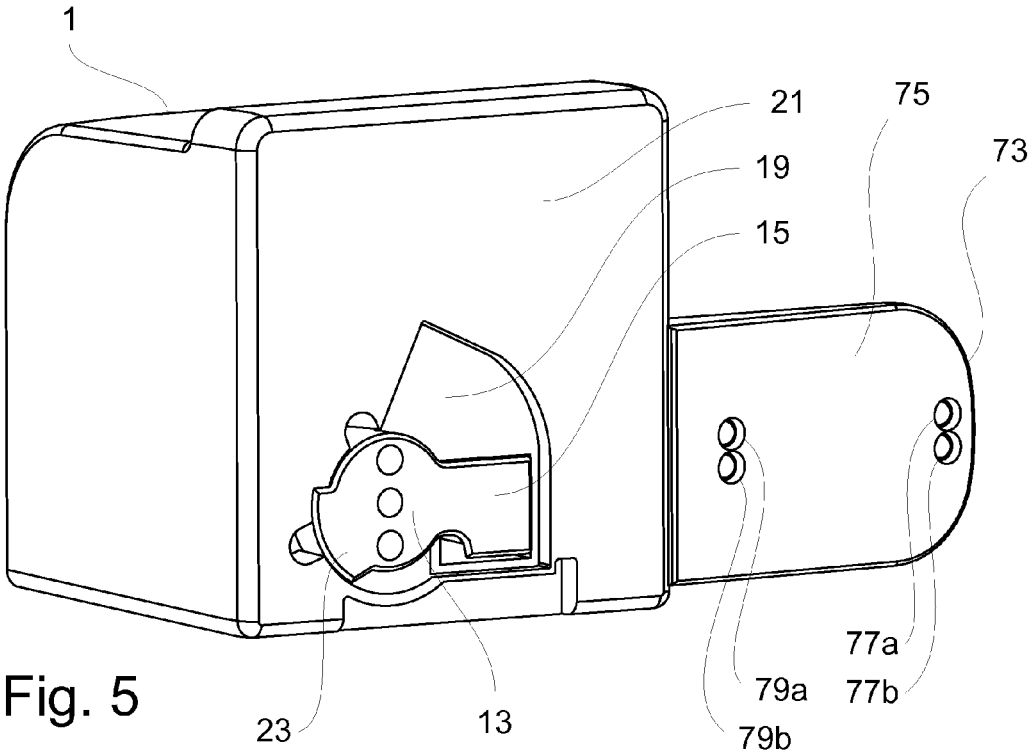
FIG. 5 shows the print head with its capping shutter closed.

FIG. 4 shows the print head 1 with the shutter 13 in the open position and FIG. 5 shows the print head 1 with the shutter 13 in the closed position, with the print cartridge 7 removed. The print head 1 has a space 17 for receiving the print cartridge 7. The space 17 is a mount for holding the print cartridge 7, and is shaped so as to hold the print cartridge 7 securely in place in a predetermined (printing) position. A clip (not shown) interacts with the print cartridge 7 at or near the rear end of the print cartridge (i.e. the end remote from the print face 9 and the rows 11 of print nozzles) to prevent the print cartridge 7 from moving out of position in the space 17 during operation of the printer. Adjacent the space 17 there is a recess 19 for accommodating the capping arm 15 of the shutter 13 in the open position. The recess 19 is deep enough to accommodate the full thickness of the capping arm 15, so that it can move back fully behind the plane of the front surface 21 of the print head 1.

As can be seen in FIG. 4, once the shutter 13 reaches the open position, further rotation is prevented by obstruction between the capping arm 15 and the edge of the recess 19. The shutter 13 has a block 23 extending radially approximately opposite the capping arm 15. The shutter 13 fits in an aperture in the print head 1 that is shaped to accommodate the block 23 when the shutter 13 is in the open position, the closed position or any intermediate position. However, movement beyond the closed position of the shutter 13 is prevented by obstruction between the block 23 and a side surface 25 of the aperture in the print head.

As can be seen in FIGS. 4 and 5, the print head 1 has a product ramp 73, in the form of an extension of the print head, at one side of it. This extends in the direction towards the oncoming products 3 to be printed onto. As shown in FIG. 1, this extension (or a least the front face 75 thereof) is angled so that its end towards the oncoming products 3 is further back that the front surface 21 of the print head 1, and is approximately level with the edge of the conveyor 5. Therefore if any products 3 are misplaced on the conveyor 5 too close to the edge, so that they would strike the side of the print head 1, they will be caught by the front face 75 of the extension 73 which acts as a ramp to push the product 3 away from the edge of the conveyor 5 as it approaches the print head 1. In this way, the misplaced product 3 is guided so as to travel correctly past the front surface 21 of the print head 1.

The ramp portion (ramp extension) 73 has two product sensors 77, 79 facing the conveyor 5. These detect the presence of a product 3. Any convenient product sensing arrangement can be used. In the illustrated embodiment, each sensor 77, 79 comprises a light source 77*a*, 79*a* (e.g. an LED) and a light detector 77*b*, 79*b*. When a product 3 passes in front of a sensor 77, 79, light from the light source 77*a* 79*a* is reflected by the product 3 back to the light detector 77*b* 79*b*, and in this way the presence of the product 3 is detected. In order to allow the detector 77*b*, 79*b* (or the electronics receiving its output signal) to distinguish light from the light source 77*a*, 79*a* (which signifies the presence of a product) from other ambient and stray light in the environment, the light source 77*a*, 79*a* is modulated. The pattern of modulation is not important, so long as it allows light from the light source to be distinguished from other light. For example, the modulation may be a steady 5 kHz. Other frequencies may be used, and complex modulation patterns may also be used if desired. The light from light sources 77*a*, 79*a* may be in the visible spectrum, but it is preferred to use near infra-red such as light of about 850 nm.

The detection of a product by the sensors 77, 79 informs the printer that a product 3 is approaching, and is used by the printer to trigger a print operation. Additionally, if the rows 11 of print nozzles are capped by the shutter 13, the printer will trigger an uncapping operation. Because there are two sensors 77, 79 and they are a known distance apart in the direction of travel of products 3 on the conveyor, the printer can use the time difference between the detections of a product 3 by the two sensors to monitor the conveyor speed. The printer uses the conveyor speed information to determine how long to wait after the product 3 is detected before beginning to print, and also how quickly to print successive columns of print in order to provide the desired column spacing of the print on the product 3.

Usually, the printer will use the sensor 77 that is further from the position of the rows 11 of print nozzles, and is more upstream with reference to the direction of travel of the products 3, to trigger a print operation and trigger an uncapping operation, as this will give the printer more time in which to respond to the detection of a product. The more downstream sensor 79 is normally used only for the speed measurement.

Preferably the ramp portion 73 is detachable from the print head 1, and can be re-attached on the other side of the print head 1, so that the print head 1 can be positioned on whichever side of the conveyor 5 is desirable.

Various other arrangements of product ramp 73 and product sensors are possible, but the arrangement used in this embodiment is convenient for the user.

The product sensors 77, 79 could be provided separately from the print head 1, and mounted at suitable location upstream of the print head. However, this requires the operator to perform an extra job (fixing up the sensors) when setting up the printer, and a suitable location for them on the product line has to be found. Additionally, since the printer needs to know the distance between the product sensor and the print head 1 in order to determine when to print, this distance has to be measured and entered into the printer in order for printing to be carried out properly. By attaching the product sensor to the print head 1, the set-up of the printer is considerably simplified.

The ramp 73 could be a separate piece of equipment, fixed to in position at the edge of the conveyor at any suitable location upstream of the print head 1. However, this requires the operator to perform an extra job (fixing the ramp) when setting up the printer, and a space for it has to be found on the product line. Additionally, if the ramp 73 is to contain either or both of the product sensors 77, 79, then the distance from the print head 1 has to be entered into the printer as explained above.

It is also possible to use only one product sensor 77, for detecting the presence of a product 3 and triggering a print operation, if some other arrangement is used for monitoring the product speed. For example, the speed of the conveyor 5 may be monitored using a shaft encoder turned by the conveyor 5. However, once again this requires that a separate piece of equipment (the shaft encoder or other speed monitor) is installed, and the output of the separate piece of equipment must be input to the printer so that it knows the speed of products along the conveyor 5.

Figure 6:
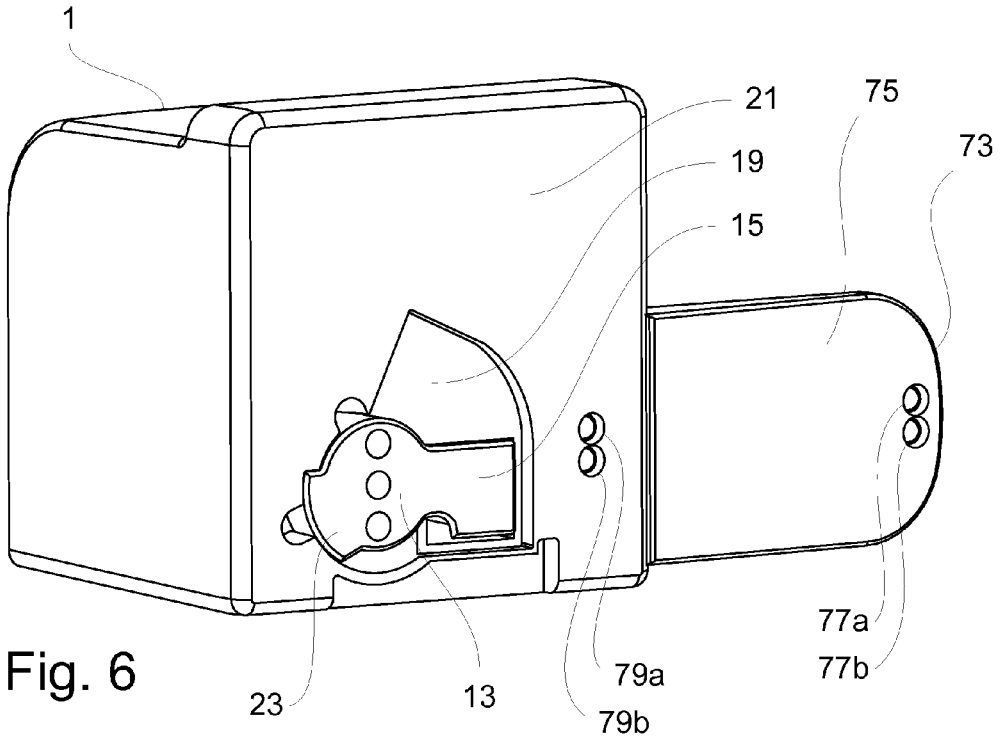
FIG. 6 shows the print head with an alternative arrangement of product sensors.
Figure 7:
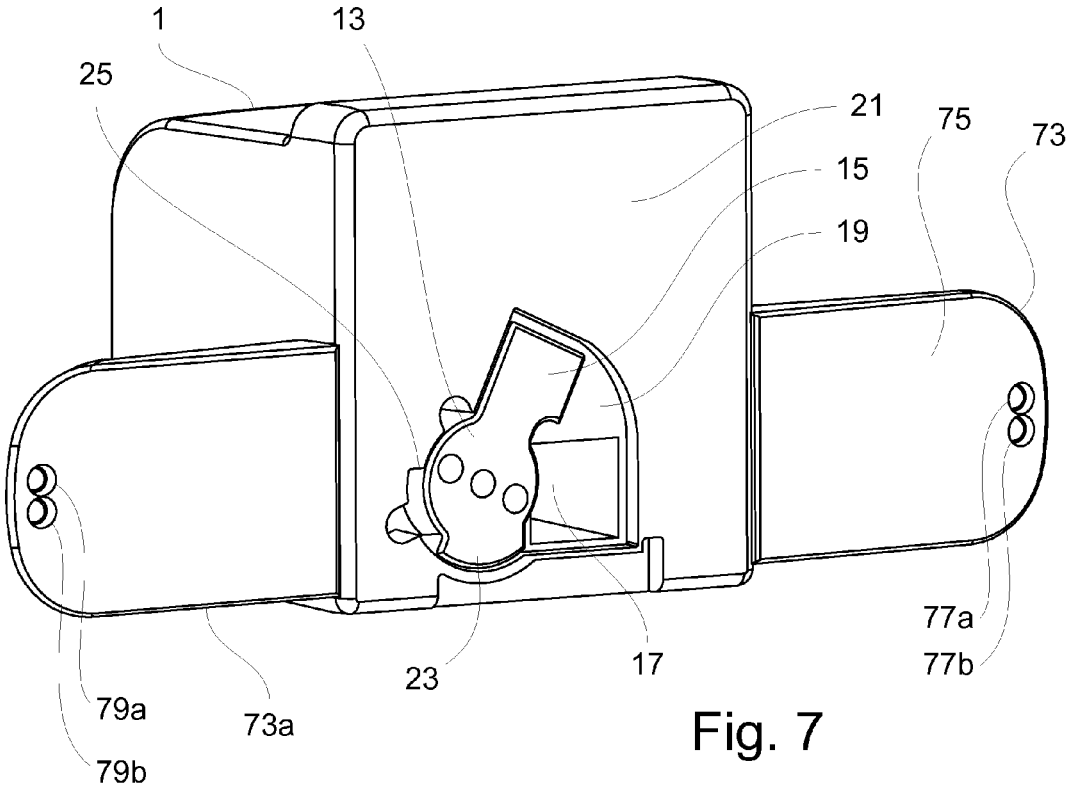
FIG. 7 shows the print head with an alternative arrangement of product ramps.

The second product sensor 79, used with the first product sensor 77 to monitor the line speed of the conveyor 5 and the products 3 on it, may be provided on or attached to the print head 1 but not on the ramp 73. It may also be provided on the far side of the print face 9 from the first product sensor 77. For example, FIG. 6 shows an alternative construction in which the second product sensor 79 is part of the print head 1 and not on the ramp 73. FIG. 7 shows a further alternative, in which there are two ramps, 73, 73*a*, one on each side of the print head. Each ramp has a respective sensor 77, 79. Whichever direction the products 3 are carried past the print head 1 by the conveyor 5, the sensor 77 or 79 on the ramp 73 or 73*a* that is upstream is used to trigger the print operation and the shutter opening operation, and the two sensors 77, 79 are used together to measure the product speed. In this construction, the ramp 73 does not have to be repositioned on the other side of the print head if the print head 1 is moved to the other side of the conveyor or if the conveyor is run in the opposite direction. Additionally, since the sensors 77, 79 are further apart, the speed of the products 3 on the conveyor can be measured more accurately. However, the speed of an individual product cannot be measured until its leading edge has passed both of the product sensors 77, 79, and if one sensor is positioned downstream of the printing position it may not be possible to determine the speed of the product in time to use that information during the operation of printing on that product. Therefore constructions such as the one shown in FIG. 7 may be used to monitor the speed of the conveyor 5, and detect changes in the conveyor speed over time, rather than to measure the speed of each product 3 individually for use in the print operation on that product.

By fitting the sensor 77, for detecting the presence of product 3, on the ramp 73, and providing the ramp 73 as an extension that is part of or is fixed to the print head 1, and additionally providing a second product sensor 79, for use with the first sensor to monitor product speed, on the ramp or alternatively on the print head or fixed to it at some other position, the printer is made substantially self-contained, and once the print head 1 has been fixed to in position at the conveyor 5 it is able to: (a) deflect products that would collide with it; (b) detect the presence of products in order to trigger print operations; and (c) to monitor the product speed, without the need for additional equipment to be mounted at the conveyor and connected to provide a signal to the printer and without the need for the operator to input the distance between the print head 1 and the product sensor 77.

Figure 8:
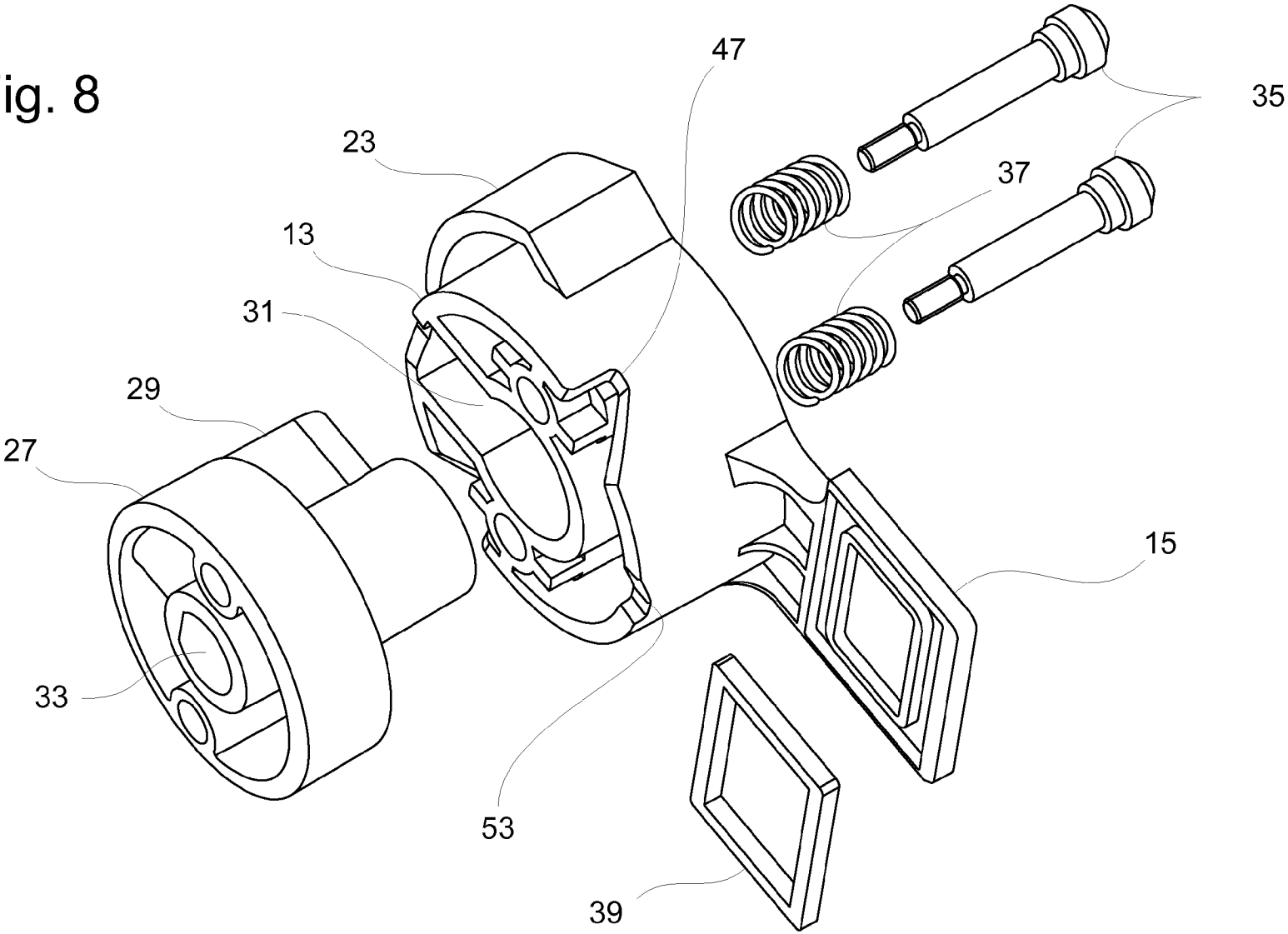
FIG. 8 is an exploded view of the shutter and associated components.

FIG. 8 is an exploded view of the shutter 13 and associated components. A drive member 27, for driving the shutter 13 in rotation, sits behind the shutter 13 and has a drive key 29 that fits into a keyhole-shaped opening 31 in the back of the shutter 13 to impart rotational movement. The drive member 27 has an opening 33 in its rear, to receive a drive spindle 28 of a motor 30 (shown in FIGS. 9 to 11). If necessary, a clamping screw can be fitted through the drive member 27, behind the drive key 29, to clamp the drive member 27 to the drive spindle 28 of the motor 30.

The shutter 13 is free to move axially relative to the drive member 27, and is retained by bolts 35 that pass through it and are secured in the drive member 27. Springs 37 are captured between the heads of the bolts 35 and the shutter 13, so as to force the shutter 13 resiliently towards the drive member 27. In this way, rotation of the motor 30 will rotate the shutter 13 through the action of the drive member 27, but the shutter 13 is free to move axially away from the drive member 27 through the interaction of cam surfaces (as will be described later), and the springs 37 force the shutter 13 against the cam surfaces and ensure that it returns towards the drive member 27 when the cams permit.

In order to allow a good seal between the capping arm 15 of the shutter 13 and the print face 9 of the print cartridge 7, taking into account any slight tilt or unevenness in the print face 9, it is advantageous for the capping arm 15 to have a resilient gasket 39 fitted into it, so that the actual contact with the print face 9 is made by the gasket 39. When the shutter is in its closed position, the resilience of the gasket 39 allows it to be compressed where necessary to accommodate a slight tilt or unevenness in the print face 9 so as to provide a good seal around the nozzles. It is advantageous to ensure that a good seal is made over the entire circumference of the gasket. It has been found that, when a highly volatile ink is used, a gap between the gasket and the print face of as little as 0.05 mm (less than the thickness of a normal sheet of paper) can allow the ink to dry and clog the print nozzles.

It is also preferable if the cap portion that holds the gasket 39 is able to tilt. In this case, an overall tilt in the print face 9 may be accommodated by tilting of the cap portion that holds the gasket 39, and the compressibility of the gasket may accommodate unevenness, roughness or undulations in the print face 9, thereby providing a good seal. The ability of the cap member holding the gasket to tilt could be provided e.g. by fitting the gasket 39 to a cap member that is tiltably mounted on the capping arm 15. However, in the present embodiment this ability to tilt is provided by making the entire shutter 13 free to tilt slightly relative to the axis of rotation. The clearance between the shutter 13 and the drive member 27, and between the shutter 13 and the bolts 35, is enough to allow the shutter 13 to tilt by at least 2° relative to the axis of rotation of the drive spindle 28, and preferably by at least 3°. This is preferred over a tiltably mounted capping member on the grounds that it is a simpler and more robust construction.

Additionally, both the resilient compression of the gasket 39 and the tilting of the shutter 13 (or tilting of whatever part holds the gasket 39) is assisted by the provision of a resilient biasing force on the member holding the gasket 39, to press it towards the print face 9, when in the closed position. Such a force helps to ensure that the compression of the gasket and/or tilting of the part holding the gasket occurs as necessary to provide a good seal around the nozzles, even if the print face is slightly further back than expected or is at an angle.

The compressibility of the gasket 39, the ability of the shutter 13 (or other part holding the gasket 39) to tilt, and the biasing force towards the print face are particularly useful in embodiments, such as the one shown in the drawings, where the print face 9 having the print nozzles is a face of a replaceable print cartridge 7 (possibly also including one or more ink reservoirs), or where the print face 9 is a face of a removable nozzle unit that can be removed and replaced if there is a problem with the print nozzles. In these cases, the new print face 9 after replacement may not be in exactly the same position and at the same angle as the old print face 9 was before replacement. The difference in position and/or angle of the print face can be accommodated by a change in the compression of the gasket 39 and/or a change in the direction or angle of tilt of the shutter 13 in the closed position, to allow a good seal between the capping arm 15 of the shutter 13 and the print face 9 regardless of the difference in position and/or angle of the print face 9.

The gasket 39 is made of a closed cell synthetic rubber foam, preferably EPDM (ethylene propylene diene monomer). It has been found that a closed cell foam is preferable to an open cell foam, because an open cell foam tends to absorb ink with the result that a gasket made with an open cell foam may become sufficiently laden with ink that it sticks to the print face 9 of the print cartridge 7, inhibiting movement of the shutter 13 from its closed position to its open position.

The shutter itself is made of polyoxymethylene (POM—acetal resin) for example a homopolymer POM such as DuPont Delrin (Trade Mark). The drive member 27 and the main body of the print head 1 may be made from a fibre-reinforced polyamide or polyester (especially a poly-terephthalate) such as 30% glass filled polyhexamethylene adipamide (nylon 66) or 30% glass filled polybutylene terephthalate (PBT). The shutter 13 is made of a different material from the print head 1 in order to minimise wear while maintaining a low coefficient of friction. The surface layers of the drive member 27 and the print head 1 are preferably not glass filled, especially at the cam surfaces of the print head 1 to be described later, in order to avoid increased wear that can arise if glass fibres are present at the surface. In order to allow the shutter 13 to move axially relative to the bolts 35, it is advantageous if the surfaces of the bolts 35 where they pass through the shutter 13 are very smooth, for example having a surface Ra of 0.8 to 0.4 μm.

Figure 9:
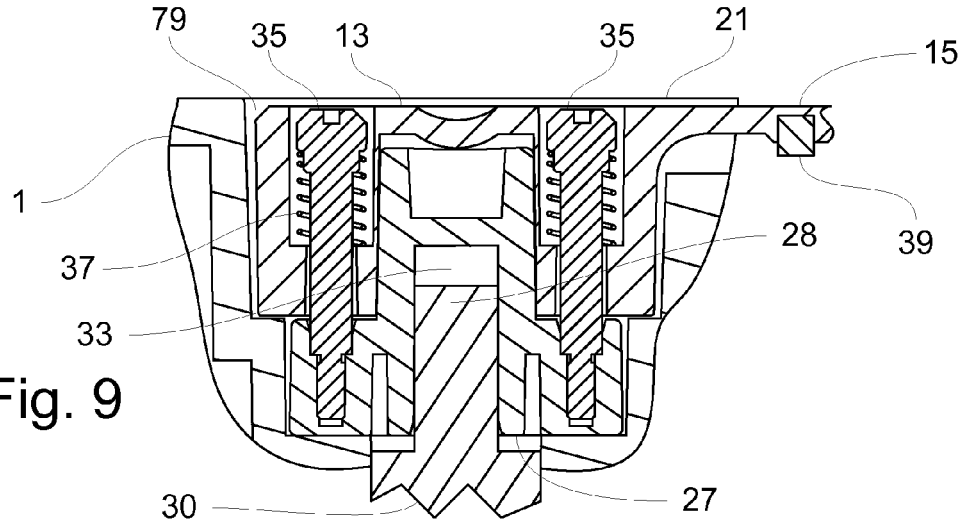
FIG. 9 is a sectional view of the shutter and part of the main body of the print head, with the shutter open.
Figure 10:
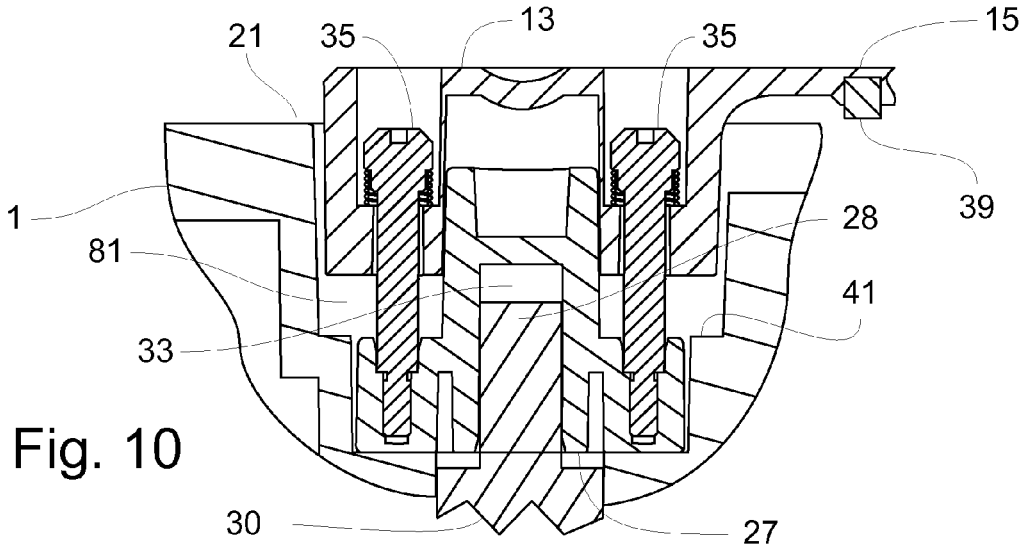
FIG. 10 is a sectional view of the shutter and part of the main body of the print head, with the shutter in an intermediate position.
Figure 11:
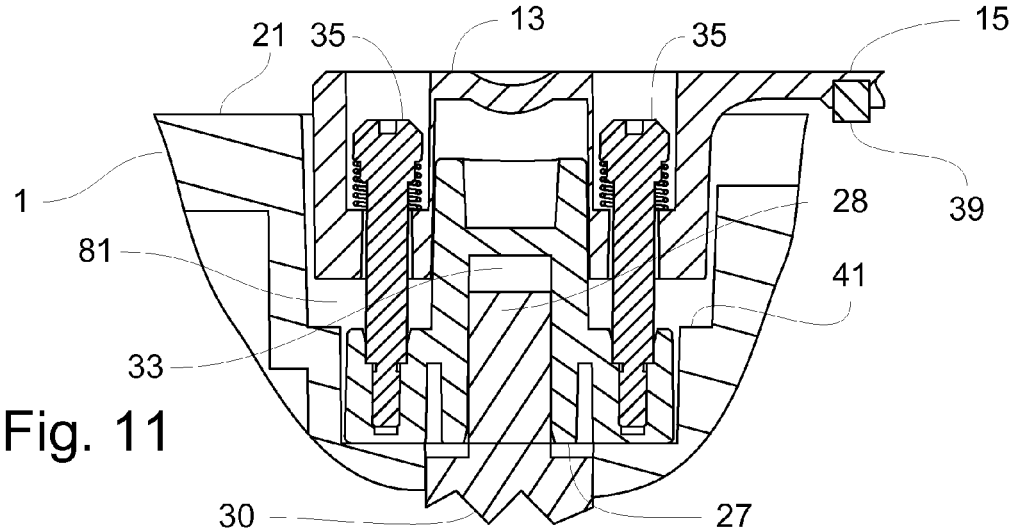
FIG. 11 is a sectional view of the shutter and part of the main body of the print head, with the shutter closed.

FIGS. 9, 10 and 11 are sectional views showing how the shutter 13 moves axially relative to the main body of the print head 1 and the drive member 27, compressing the springs 37, as the shutter 13 rotates to move the capping arm 15 between the open and closed positions. In order to assist understanding, these figures show part of the capping arm 15 as if it was in the same section plane as the bolts 35, although in fact the capping arm 15 extends at right angles to this plane. These figures also show how the drive spindle 28 of the motor fits into the drive opening 33 of the drive member 27.

In FIG. 9 the shutter 13 is in the open position. As can be seen, the springs 37 are relatively extended and the front face of the shutter 13 is recessed relative to the front surface 21 of the print head 1. Accordingly, in this position the shutter 13 is entirely out of the path of products 3 passing the print head 1.

In FIG. 10 the shutter 13 is in an intermediate position between the open position and the closed position. Accordingly, it has moved along the axis of rotation, away from the drive member 27, compressing the springs 37. The full thickness of the capping arm 15, including the gasket 39, is beyond the front surface 21 of the print head 1, and therefore it is also clear of the print face 9 of the print cartridge 7. Accordingly, in this position the capping arm 15 can move across the print face 9 without making sliding contact that could damage any of the nozzles in the two rows 11.

FIG. 11 shows the shutter 13 in the closed position. As compared with the intermediate position of FIG. 10, the shutter 13 has moved back slightly towards the drive member 27, allowing the springs 37 to expand slightly. The springs 37 act on the shutter 13 to press it towards the drive member 27, and this has the effect of pressing the capping arm 15 towards the print face 9 of the print cartridge 7, ensuring that the gasket 39 seals against the print face 9 (the print cartridge 7 is not shown in these figures, for clarity of illustration). In this way, the springs 37 provide the resilient biasing force towards the print face 9, discussed above, that assists the compressibility of the gasket and the tiltability of the shutter 13 to provide a good seal against the print face 9.

Figure 12:
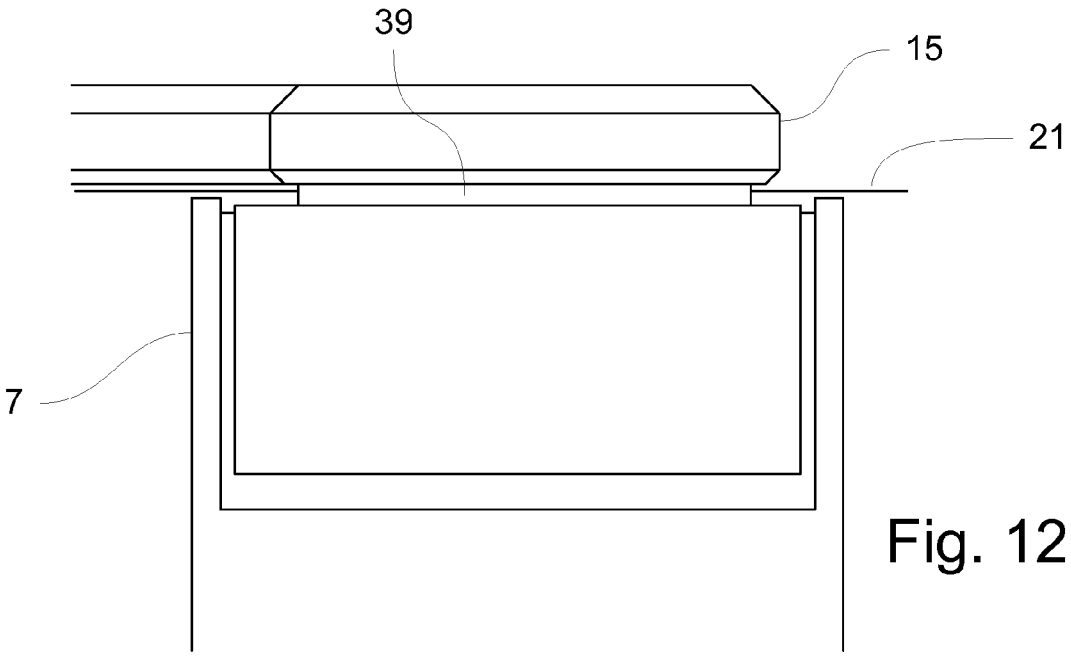
FIG. 12 is a side view of the front part of a print cartridge, capped by the shutter.

FIG. 12 shows part of the print cartridge 7 and the capping arm 15 from the side, when the shutter 13 is in the closed position, with the capping arm 15 pressed against the print face 9 of the print cartridge 7 so that the gasket 39 is in contact with the print face 9 and seals the two rows 11 of print nozzles.

Figure 13:
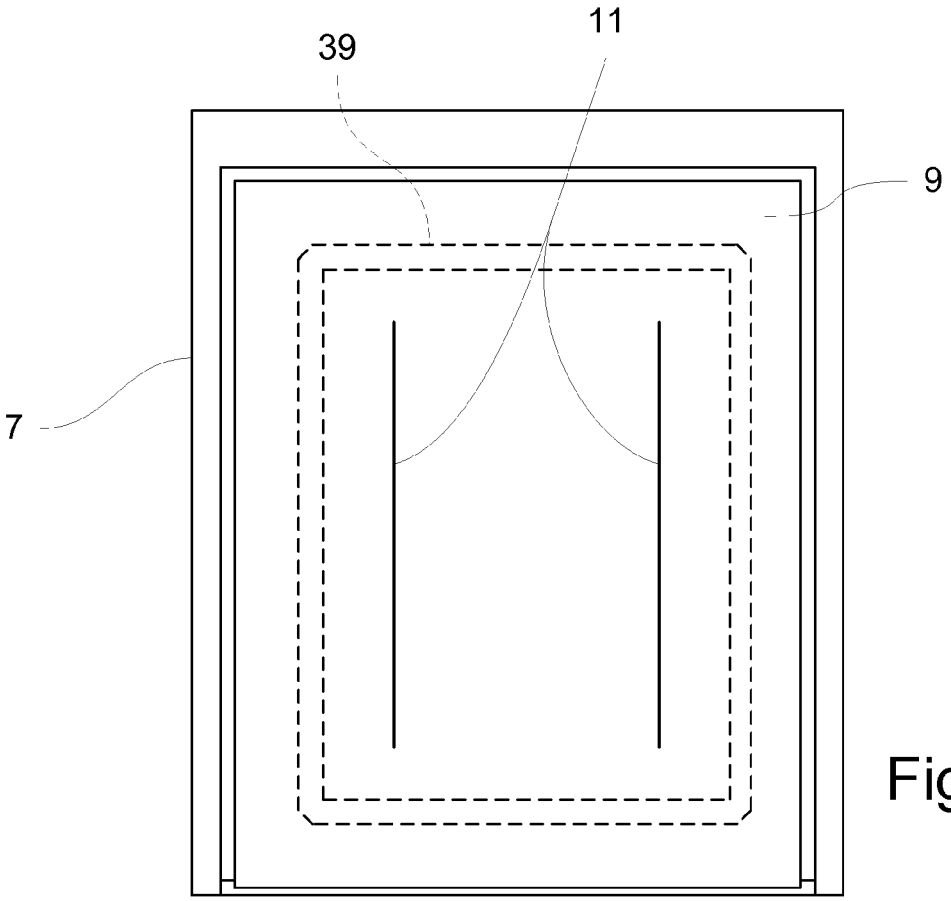
FIG. 13 is a front view of the print face of the print cartridge of FIG. 12.

FIG. 13 shows the front face of the print cartridge. The broken lines show the position on the print face 9 where it is contacted by the gasket 39. As can be seen in the figure, the gasket seals round the lines 11 of print nozzles without contacting any of the nozzles.

Returning to FIG. 9, it can be seen that the outer diameter of the main body of the shutter 13 is slightly larger than the outer diameter of the drive member 27, so that the rear surface of the shutter 13 faces a ledge 41 of the main body of the print head 1. Consequently, as the drive member 27 and the shutter 13 rotate, the rear surface of the shutter 13 moves relative to the ledge 41. Cam surfaces on the ledge 41 and rear surface of the shutter 13 interact to provide the necessary axial movement of the shutter 13. This camming action is illustrating in FIGS. 14, 15 and 16.

Figure 14:
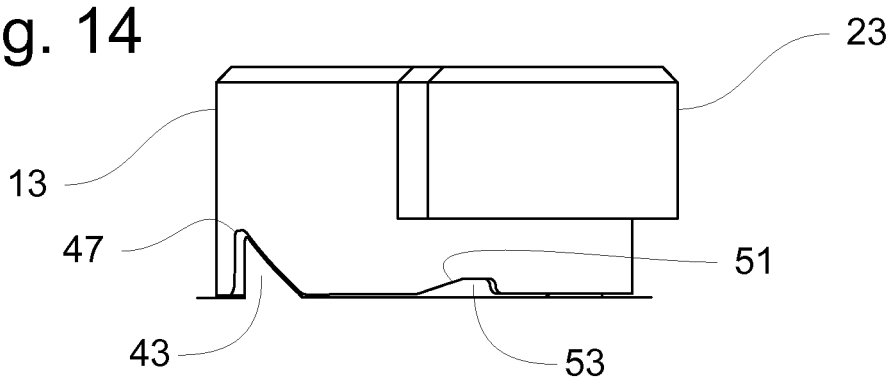
FIG. 14 is a side view of the shutter showing a cam arrangement, with the shutter open.
Figure 15:
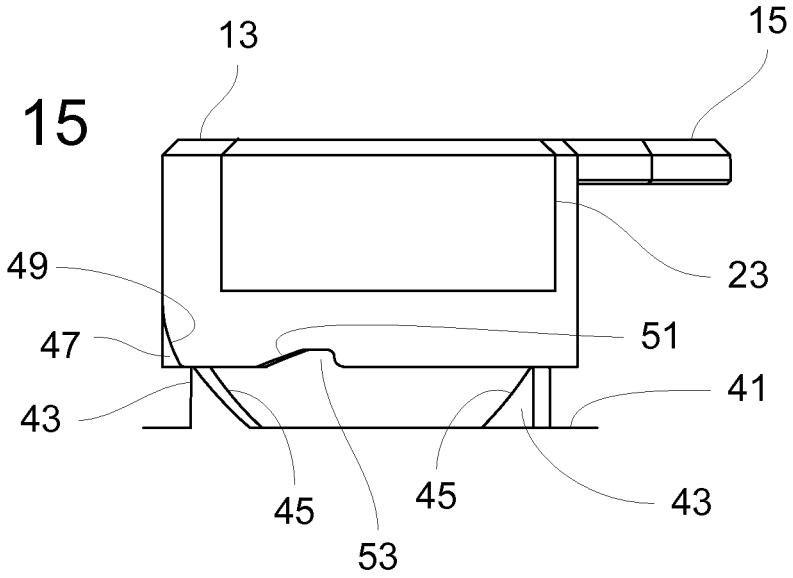
FIG. 15 is a side view of the shutter showing a cam arrangement, with the shutter in an intermediate position.
Figure 16:
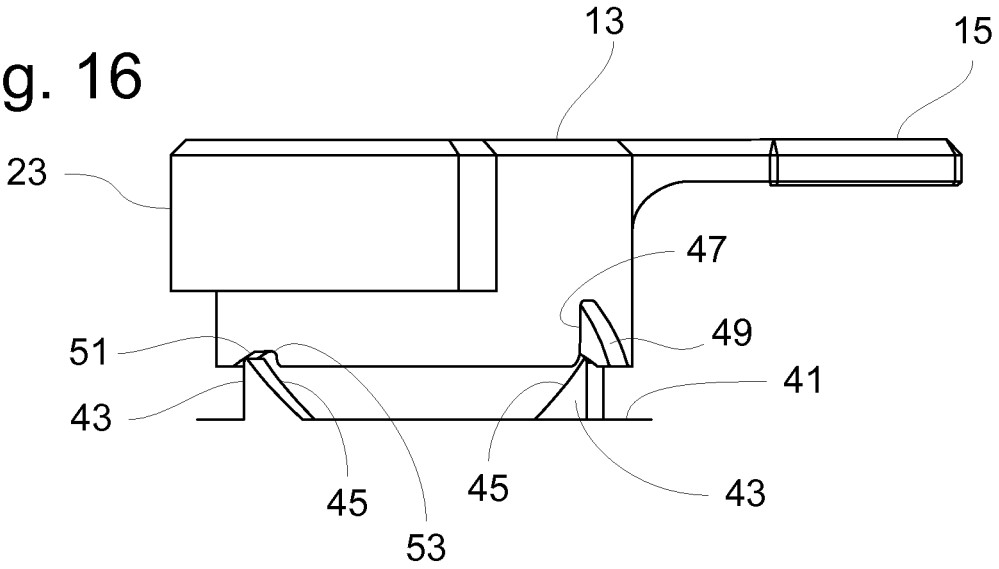
FIG. 16 is a side view of the shutter showing a cam arrangement, with the shutter closed.

As can be seen most clearly in FIGS. 15 and 16, the ledge 41 has two triangular cam protrusions 43, diametrically opposite each other. Each cam protrusion 43 has a sloping cam surface 45 for interaction with the shutter 13. The shutter 13 has two triangular recesses 47, diametrically opposite each other, that can accommodate the cam protrusions 43 on the ledge 41. One of these recesses 47 can be seen in FIG. 14 accommodating one of the protrusions 43, and the other recess 47 can be seen in FIG. 16. The recesses 47 can also be seen in FIG. 8. Each recess 47 has a sloping cam surface 49 for interaction with the cam surface 45 of the protrusions 43. Consequently, when the recesses 47 in the rear of the shutter 13 are aligned with the protrusions 43 on the ledge 41, the shutter 13 is pressed back against the ledge 41 by the springs 37, as shown in FIG. 14 (and also FIG. 9). This is the position of the shutter 13 when the print face 9 of the print cartridge 7 is fully uncapped and the capping arm 15 of the shutter 13 is accommodated in the recess 19 of the print head 1, so that the shutter 13 is further back than the print face 9 and the front surface 21 of the print head 1.

As the shutter 13 rotates, the cam surfaces 45, 49 slide over each other, forcing the shutter 13 forwards away from the ledge 41, compressing the springs 37, until the cam protrusions 43 exit the recesses 47 entirely. With further rotation of the shutter 13, the tips of the cam protrusions 43 slide over the rear surface of the shutter 13. This position is shown in FIG. 15, and also in FIG. 10. The shutter 13 has now been forced forwards sufficiently that the capping arm 15, including the gasket 39, is further forward than the print face 9. This ensures that the capping arm 15 does not contact the print face 9 as further rotation of the shutter 13 moves the capping arm 15 across the print face 9. There is a clearance of about 0.5 mm between the gasket 39 and the print face 9 in the position shown in FIGS. 10 and 15.

Once rotation of the shutter 13 has brought the capping arm 15 over the print face 9, and the capping arm 15 approaches the correct position for capping the print face 9, the tips of the cam protrusions 43 on the ledge 41 begin to slide along shallowly sloping cam surfaces 51, so that the protrusions 43 begin to enter further small recesses 53 in the rear surface of the shutter 13, as shown in FIG. 16. This allows the capping arm 15 to move axially (rearward) towards the print face 9, allowing the gasket 39 to make contact with the print face 9 and cap the rows 11 of nozzles. The shallow recesses 53 can also be seen in FIG. 8.

In order to ensure that the gasket 39 is pressed firmly against the print face 9, and to accommodate slight variations in the position of the print face 9 on different print cartridges 7, the shallow recess 53 is made deep enough to permit movement of the shutter 13 axially rearwards sufficiently to cap a print face 9 at the rearmost expected position. However, this means that if the print face 9 is at the forwardmost expected position, the gasket 39 will begin to contact it slightly before the shutter 13 has stopped rotating, so that the gasket 39 will scrape across the print face 9 for the last part of the movement of the shutter 13. Therefore the position of the cam surface 51 of the recesses 53, and the angle of slope of the cam surfaces 51, must be selected to ensure that any such sliding contact between the gasket 39 and the print face 9 does not move the gasket 39 over any part of the print face 9 where it might damage any of the print nozzles. The regions of the print face 9 where such sliding movement is acceptable, and the regions where it is not acceptable, may be specified by the manufacturer of the print cartridge 7, and the shape and position of the recesses 53 in the rear of the shutter 13 may be designed in order to match the requirements of the particular model of print cartridge 7 intended to be used in the print head 1.

The feature that no part of the shutter 13 contacts the print nozzles while the shutter moves and also when the shutter is in its closed position, has been found to be advantageous. Depending on the nature of the ink being used (especially the solvent used in the ink) and also on ambient temperature, the preferred time to allow the print nozzles to be uncapped after printing may vary from about 2 seconds to about 1 minute. The frequency with which the nozzle has to be capped will depend on how often the conveyor 5 stops, and also on the interaction between the preferred time from the end of printing to capping the nozzles with the size and spacing of the products 3 and the length of printing required on each product 3. If the products 3 are much longer than the required length of printing, or are significantly spaced along the conveyor 5, there may be a gap of 5 to 10 seconds, or more, between each print operation. If this is the case, and the preferred waiting time after printing before capping is 5 seconds or less, the nozzles could be capped between each print operation. Consequently, it is possible that the printer might cap and uncap the print nozzles 100 times per hour on some packing lines. Under these circumstances, long term reliability of the print nozzles is enhanced by avoiding contact between them and the shutter 13.

In operation of the printer, selected print nozzles from the rows 11 are fired (i.e. an ink drop is ejected from the nozzle) at selected times to print the desired pattern on the product 3 passing the print head 1. At this time, the shutter is in its open position, and is recessed in the space 19 so that it is out of the path of the products 3 passing along the conveyor 5. If a predetermined time expires after the end of printing without a further product being detected by the sensor 77, the motor 30 in the print head 1 is actuated to rotate the drive member 27 so as to move the shutter 13 from its open position to its closed position in which it caps the print nozzles. The length of the predetermined time may vary between e.g. 2 seconds and e.g. 60 seconds, depending on a variety of factors such as the type of ink being used (and especially the type of solvent in the ink), the ambient temperature, etc. As the shutter 13 rotates, driven by the drive member 27, interaction between the cam surfaces 45, 49 drives the shutter 13 along the axis of rotation towards so that the capping arm 15 clears the plane of print face 9 of the print cartridge 7. The capping arm 15 moves across the print face 9 without touching it, until it covers the rows 11 of print nozzles. As the shutter 13 approaches the closed position, the cam protrusions 43 enter the shallow recesses 53, allowing the shutter 13 to move back along the axis of rotation under the influence of the springs 37, with the result that the capping arm 15 presses the gasket against the print face 9, sealing around the print nozzles. The speed of this closing movement is not critical, but it should take substantially less than a second (e.g. no more than one tenth of a second) so that it is a small fraction of the period that the printer waits after completing a printing operation before closing the shutter 13.

While the shutter 13 is closed, the printer may fire the nozzles from time to time, in order to prevent the nozzles from becoming blocked. The frequency with which this is done will normally depend on the ink type and the temperature. In order to avoid excessive ink consumption, this nozzle firing may cease after the shutter has remained closed for a predetermined time. In this case, the nozzles might be fired several hundred times to clear them when the printer is restarted after a shutdown of a day or more. Even if the shutter has been closed only briefly between products, or for a shutdown of the conveyor 5 for a few minutes, the printer may fire the nozzles a few times (e.g. five times) to ensure that they are not clogged, when the sensor 77 detects a product. In response to detection of a product by the sensor 77, and after any nozzle firing, the motor 30 is operated to rotate the drive member 27 and drive the shutter 13 from its closed position to its open position. The movement of the shutter in this operation is the reverse of its movement from the open position to the closed position. The shutter 13 must clear the print face 9, so as to allow the nozzles to print, and must retract axially to be behind the front face 21 of the print head 1 so as to be out of the path of the product 3, before the product 3 reaches it. Therefore this movement should be done quickly. The maximum permitted time will depend on the distance between the sensor 77 and the printing position of the print head 1 (i.e. the position of the print face 9 in the illustrated embodiment) and the speed of the conveyor 5. Typically, the movement of the shutter 13 from the closed position to the open position should take for example between 50 and 100 milliseconds, and preferably no more than 80 ms, in order to allow the printer to be used with high speed conveyors, moving e.g. at up to 1 metre per second. An even shorter time for the opening movement of the shutter, e.g. no more than 40 milliseconds and preferably no more than 30 milliseconds, will allow the printer to be used with even higher speed conveyors (e.g. moving at 2 metres per second) or a reduced distance between the product sensor 77 and whichever is the closer of the open position of the shutter and the position of the print face 9.

In this embodiment, the shutter 13 is pressed back towards the ledge 41, so that it is forced onto the cam protrusions 43, by the springs 37, as shown in FIGS. 9 to 11, and the springs 37 also provide the force to ensure that the gasket 39 on the capping arm 15 is pressed against the print face 9 when the shutter is in its closed, capping, position. In principle, an alternative resilient arrangement could be used to provide the necessary axial force, such as an elastomeric block, or a completely different arrangement could be used to provide the force such as a suitable arrangement of permanent magnets. However, the springs provide a simple and compact way to provide the force.

Figure 17:
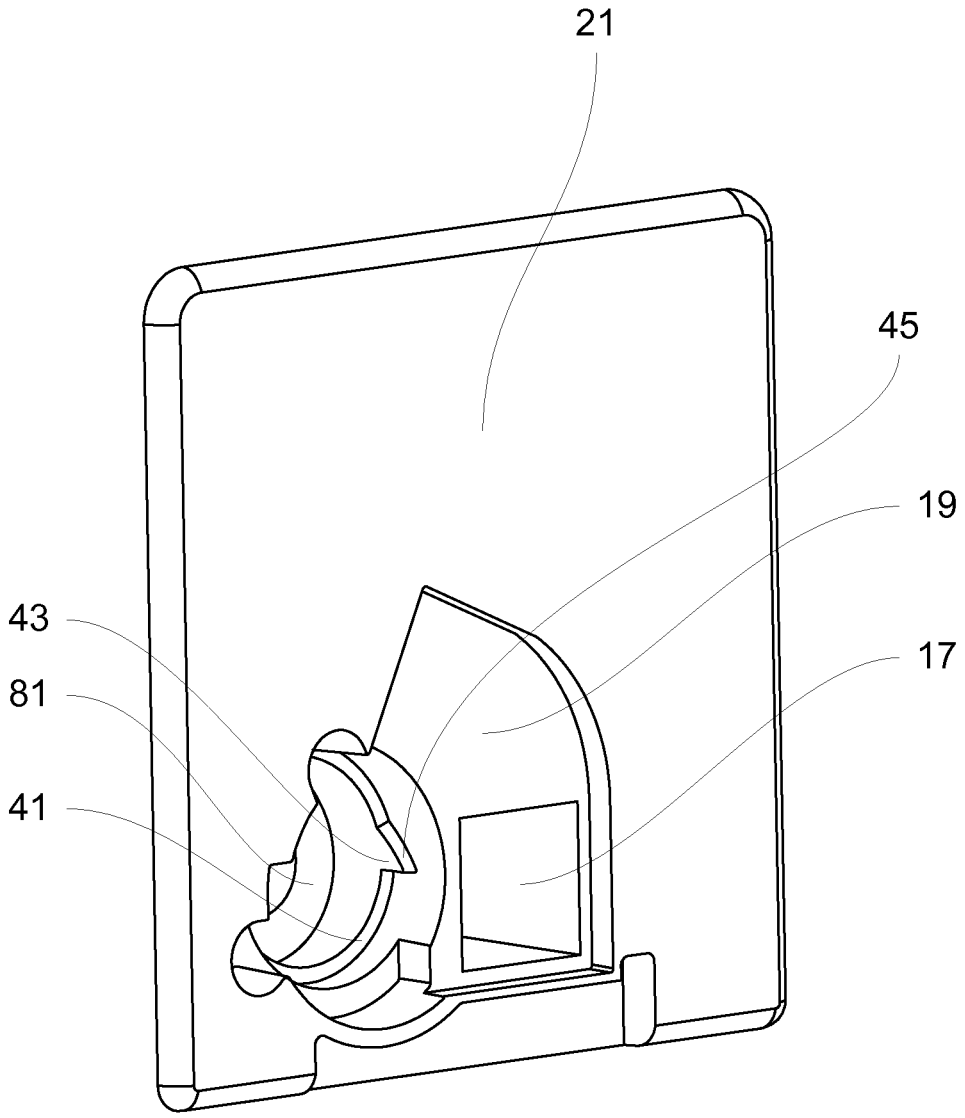
FIG. 17 shows the front face of the print head with the shutter removed.

The main body of the shutter 13, bearing the recesses 47, 53 and cam surfaces 49, 51, fits in a recess 81 in the front face 21 of the print head 1. The ledge 41, bearing cam protrusions 43, is formed in the recess 81. This can be seen in FIGS. 9 to 11, and also in FIG. 17 which shows the front face 21 of the print head 1 without the shutter 13. The shutter 13 covers the cam protrusions 43 in the open position, the closed position and in all intermediate positions as it rotates between its open and closed positions. This covering, together with the fact that the protrusions 43 are in the recess 81, provides protection to reduce the tendency of dust and dirt from the outside environment to reach the cam surfaces. This in turn reduces wear of the cam surfaces and prolongs the working life of the cam arrangement. The fact that the shutter 13 rotates between its closed and open positions, rather than sliding linearly, makes it easier to ensure that the cam surfaces are protected at all times during the opening and closing movements.

In the illustrated embodiment, the cam protrusions 43 are on the ledge 43 in the recess 81 of the print head 1, and the cam recesses 47, 53 are in the underside of the shutter 13. However, this is not essential and the cam protrusions 43 could be on the shutter 13 while the recesses 47, 53 could be in the ledge 43. Preferably, the cam protrusions are positioned so that when the shutter 13 is in its closed position the cam protrusions 43 are lined up in a direction that intersects the position of the print face 9. In this position, the shutter is supported on the tips of the cam protrusions 43, and so it can easily wobble about the line defined by the cam protrusions 43. Consequently, the line defined by the cam protrusions 43 acts as a tilt axis for tilting of the capping arm 15 as it is pressed against the print face 9 in the closed position of the shutter 13. Preferably, the bolts 35, and the springs 37 captured between the bolts 35 and the shutter 13, are positioned to either side of this line, as can be seen for instance in FIG. 8. The springs 37 provide a force that presses the capping arm 15 firmly against the print face 9 while allowing tilting movement about the line defined by the cam protrusions 43.

Alternative arrangements could be used to create the axial movement of the shutter 13, in place of the cam protrusions and recesses 43, 47, 53. For example, a separate drive could be used for the axial movement. However, this would increase the cost and complexity of the design and it would be necessary to ensure that the axial drive was appropriately synchronised with the rotational drive. The illustrated arrangement provides a compact and simple way of providing the correct movement for the shutter 13. Additionally, it is able to operate very quickly. This is beneficial since a typical installation of the print head 1 on a modern high speed factory conveyor line may require that the shutter moves from the capping position to the open position (or at least, to a position where the shutter is fully withdrawn out of the path of products 3 moving along the conveyor 5, even if it has not completed its movement to its final rest position) in no more than 80 milliseconds.

The arrangements described thus far are merely embodiments of the invention, and variations and alternative arrangements are possible. Preferably the variations or alternative arrangements should ensure that the cap is pressed against the print face when in the closed (capped) position and that it is withdrawn at least as far back as the print face 9 and/or the front surface 21 of the print head or printer in the open (uncapped, printing) position, whereas the cap must be forward of the print face during all or most of its movement across the print face in order to allow this movement to take place without sliding contact between the cap and the print nozzles.

It can be seen that in all the embodiments described above, movement of the capping member (shutter 13) changes the state of the printer between a state in which it is ready to print and a state in which the print nozzles are capped, without the need to move the print head 1 or the print face 9 while changing states.

The embodiments that have been described and illustrated are provided by way of non-limiting example only, and further modifications and alternatives will be apparent to those skilled in the art.

The invention claimed is:

1. An ink jet printer or a print head for an ink jet printer, the printer or print head having a printing position from which ink can be ejected for printing and the printer or print head being suitable for mounting alongside a conveyor for ejection of ink in a direction sideways across the conveyor so that the conveyor can convey products, to be printed onto, past the printing position of the printer or print head in a conveying direction, the printer or print head comprising:

a ramp portion extending away from the printing position, the ramp portion being suitable to be mounted, when the printer or print head is mounted alongside a conveyor for ejection of ink in the direction sideways across the conveyor, so that it extends upstream, relative to the conveying direction, of the printing position and so that it has a ramp surface facing across the conveyor, the ramp surface being angled relative to the conveying direction with (a) the end of the ramp surface that is furthest from the printing position being further in a direction sideways from the conveyor than the printing position, and (b) a place on the ramp surface spaced from the end being no further in the direction sideways from the conveyor than the printing position, whereby a product conveyed by the conveyor that strikes the ramp surface between its end and the said place will be forced sideways relative to the conveying direction as it is conveyed past the ramp surface so as to be no further in the direction sideways from the conveyor than the printing position before it reaches the printing position;

a first sensor, for sensing the presence of a product passing the first sensor, the first sensor being mounted on the said ramp portion; and a second sensor, for sensing the presence of a product passing the second sensor, the second sensor being spaced from the first sensor in the direction from the first sensor towards the printing position.

2. A printer or print head according to claim 1 in which the ramp portion is detachable.

3. An ink jet printer or a print head for an ink jet printer, the printer or print head having a printing position from which ink can be ejected for printing and the printer or print head being suitable for mounting alongside a conveyor for ejection of ink in a direction sideways across the conveyor so that the conveyor can convey products, to be printed onto, past the printing position of the printer or print head in a conveying direction, the printer or print head comprising:

a ramp portion extending away from the printing position, the ramp portion being suitable to be mounted, when the printer or print head is mounted alongside a conveyor for ejection of ink in a direction sideways across the conveyor, so that it extends upstream, relative to the conveying direction, of the printing position and so that it has a ramp surface facing across the conveyor, the ramp surface being angled relative to the conveying direction with (a) the end of the ramp surface that is furthest from the printing position being further in a direction sideways from the conveyor than the printing position, and (b) a place on the ramp surface spaced from the end being no further in the direction sideways from the conveyor than the printing position, whereby a product conveyed by the conveyor that strikes the ramp surface between its end and the said place will be forced sideways relative to the conveying direction as it is conveyed past the ramp surface so as to be no further in the direction sideways from the conveyor than the printing position before it reaches the printing position;

a first sensor, for sensing the presence of a product passing the first sensor, the first sensor being mounted on the said rams portion; and a second sensor, for sensing the presence of a product passing the second sensor, the second sensor being spaced from the first sensor in the direction from the first sensor towards the printing position and between the first sensor and the printing position.

4. A printer or print head according to claim 3 in which the second sensor is mounted on the ramp portion.

5. A printer or print head according to claim 3 in which the ramp portion is detachable.

6. An ink jet printer or a print head for an ink jet printer, the printer or print head having a printing position from which ink can be ejected for printing and the printer or print head being suitable for mounting alongside a conveyor for ejection of ink in a direction sideways across the conveyor so that the conveyor can convey products, to be printed onto, past the printing position of the printer or print head in a conveying direction, the printer or print head comprising:

a ramp portion extending away from the printing position, the ramp portion being suitable to be mounted, when the printer or print head is mounted alongside a conveyor for ejection of ink in a direction sideways across the conveyor, so that it extends upstream, relative to the conveying direction, of the printing position and so that it has a ramp surface facing across the conveyor, the ramp surface being angled relative to the conveying direction with (a) the end of the ramp surface that is furthest from the printing position being further in a direction sideways from the conveyor than the printing position, and (b) a place on the ramp surface spaced from the end being no further in the direction sideways from the conveyor than the printing position, whereby a product conveyed by the conveyor that strikes the ramp surface between its end and the said place will be forced sideways relative to the conveying direction as it is conveyed past the ramp surface so as to be no further in the direction sideways from the conveyor than the printing position before it reaches the printing position;

a first sensor, for sensing the presence of a product passing the first sensor, the first sensor being mounted on the said ramp portion; and a second sensor, for sensing the presence of a product passing the second sensor, the second sensor being spaced from the first sensor in the direction from the first sensor towards the printing position and the printing position being between the first sensor and the second sensor.

7. A printer or print head according to claim 6 in which the second sensor is mounted on a further ramp portion, extending away from the printing position, the further ramp portion being suitable to be mounted, when the printer or print head is mounted alongside a conveyor for ejection of ink in the direction sideways across the conveyor, so that it extends downstream, relative to the conveying direction, of the printing position and so that it has a ramp surface facing across the conveyor, the ramp surface being angled relative to the conveying direction with (a) the end of the ramp surface that is furthest from the printing position being further in the direction sideways from the conveyor than the printing position, and (b) a place on the ramp surface spaced from the end being no further in the direction sideways from the conveyor than the printing position.

8. A printer or print head according to claim 6 in which the ramp portion is detachable.

* * * * *